US008339341B2

(12) United States Patent
Ishiguchi et al.

(10) Patent No.: US 8,339,341 B2
(45) Date of Patent: Dec. 25, 2012

(54) IMAGE DISPLAY SYSTEM WHICH PERFORMS OVERDRIVE PROCESSING

(75) Inventors: Kazuhiro Ishiguchi, Tokyo (JP); Akimasa Yuuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 933 days.

(21) Appl. No.: 12/277,821

(22) Filed: Nov. 25, 2008

(65) Prior Publication Data

US 2009/0140965 A1 Jun. 4, 2009

(30) Foreign Application Priority Data

Nov. 29, 2007 (JP) ..... 2007-308563

(51) Int. Cl.

| | |
|---|---|
| ***G09G 3/10*** | (2006.01) |
| ***G09G 3/18*** | (2006.01) |
| ***G09G 3/20*** | (2006.01) |
| ***G09G 3/32*** | (2006.01) |
| ***G09G 3/36*** | (2006.01) |
| ***G09G 5/00*** | (2006.01) |

(52) U.S. Cl. ..... 345/87; 345/42; 345/51; 345/55; 345/83; 345/88; 345/92; 345/100; 345/607

(58) Field of Classification Search ..... 345/87
See application file for complete search history.

(56) References Cited

U.S. PATENT DOCUMENTS

| | | | | |
|---|---|---|---|---|
| 5,450,130 | A * | 9/1995 | Foley | 348/391.1 |
| 7,974,485 | B1 * | 7/2011 | Azar et al. | 382/254 |
| 2002/0190993 | A1 * | 12/2002 | Narita | 345/530 |
| 2005/0052386 | A1 | 3/2005 | Kwon et al. | |
| 2005/0162360 | A1 * | 7/2005 | Ishihara et al. | 345/89 |
| 2005/0276071 | A1 | 12/2005 | Sasagawa et al. | |
| 2006/0082536 | A1 * | 4/2006 | Koyama et al. | 345/100 |
| 2006/0114317 | A1 | 6/2006 | Yuuki et al. | |

FOREIGN PATENT DOCUMENTS

| | | |
|---|---|---|
| JP | 01-102595 | 4/1989 |
| JP | 07-121143 | 5/1995 |
| JP | 08-123355 | 5/1996 |
| JP | 2003-143556 | 5/2003 |
| JP | 2004-253879 | 9/2004 |
| JP | 2004-304390 | 10/2004 |
| JP | 2005-78090 | 3/2005 |
| JP | 2005-309326 | 11/2005 |
| JP | 2007-248639 | 9/2007 |
| WO | WO 2004/027492 A1 | 4/2004 |

* cited by examiner

OTHER PUBLICATIONS

Office Action (with English translation) mailed on Sep. 4, 2012, in counterpart Japanese Patent Appin No. 2007-308563 (4 pages).

*Primary Examiner* — Alexander S Beck
*Assistant Examiner* — Karin Kiyabu
(74) *Attorney, Agent, or Firm* — Oblon, Spivak, McClelland, Maier & Neustadt, L.L.P.

(57) ABSTRACT

This invention provides an image display system that includes an image display device having an overdrive processing circuit and allows reduction in memory cost as a whole. The image display system according to this invention includes an image generation device that generates image data, and an image display device that receives the image data from the image generation device, performs overdrive processing based on the received image data, and displays an image. The image generation device includes a rendering circuit that generates image data to be outputted to the image display device for every frame, a memory unit that holds the plural pieces of image data corresponding to at least two frames among the plural pieces of image data generated by the rendering circuit, and a transfer circuit that transfers the plural pieces of image data corresponding to two frames among the plural pieces of image data held by the memory unit to the image display device within one frame period. The image display device receives the plural pieces of image data corresponding to the two frames from the transfer circuit and performs the overdrive processing based on the received image data.

11 Claims, 19 Drawing Sheets

F I G . 5

| | | 1 | 2 | ··· | 640 | 641 | 642 | ··· | 1280 | HB |
|---|---|---|---|---|---|---|---|---|---|---|
| | 1 | | | | | | | | | |
| | ··· | | | | | | | | | |
| FRAME 1 | ··· | IMAGE 1 | | | | IMAGE 0 | | | | |
| | 480 | | | | | | | | | |
| | VB | | | | | | | | | |
| | 1 | | | | | | | | | |
| | ··· | | | | | | | | | |
| FRAME 2 | ··· | IMAGE 2 | | | | IMAGE 1 | | | | |
| | 480 | | | | | | | | | |
| | VB | | | | | | | | | |
| | 1 | | | | | | | | | |
| | ··· | | | | | | | | | |
| FRAME 3 | ··· | IMAGE 3 | | | | IMAGE 2 | | | | |
| | 480 | | | | | | | | | |
| | VB | | | | | | | | | |
| | 1 | | | | | | | | | |
| | ··· | | | | | | | | | |
| FRAME 4 | ··· | IMAGE 4 | | | | IMAGE 3 | | | | |
| | 480 | | | | | | | | | |
| | VB | | | | | | | | | |

FIG. 7

| | | | | | | |
|---|---|---|---|---|---|---|
| | | 1 | 2 | ··· | 640 | HB |
| FRAME 1 | 1 | IMAGE 1 | | | | |
| | ··· | IMAGE 0 | | | | |
| | ··· | ··· | | | | |
| | 959 | IMAGE 1 | | | | |
| | 960 | IMAGE 0 | | | | |
| | VB | | | | | |
| | | 1 | 2 | ··· | 640 | HB |
| FRAME 2 | 1 | IMAGE 2 | | | | |
| | ··· | IMAGE 1 | | | | |
| | ··· | ··· | | | | |
| | 959 | IMAGE 2 | | | | |
| | 960 | IMAGE 1 | | | | |
| | VB | | | | | |
| | | 1 | 2 | ··· | 640 | HB |
| FRAME 3 | 1 | IMAGE 3 | | | | |
| | ··· | IMAGE 2 | | | | |
| | ··· | ··· | | | | |
| | 959 | IMAGE 3 | | | | |
| | 960 | IMAGE 2 | | | | |
| | VB | | | | | |
| | | 1 | 2 | ··· | 640 | HB |
| FRAME 4 | 1 | IMAGE 4 | | | | |
| | ··· | IMAGE 3 | | | | |
| | ··· | ··· | | | | |
| | 959 | IMAGE 4 | | | | |
| | 960 | IMAGE 3 | | | | |
| | VB | | | | | |

FIG. 8

| | | 1 | 2 | 3 | 4 | ··· | 1279 | 1280 | HB |
|---|---|---|---|---|---|---|---|---|---|
| FRAME 1 | 1 | IMAGE 1 | IMAGE 0 | IMAGE 1 | IMAGE 0 | ··· | IMAGE 1 | IMAGE 0 | |
| | ··· | IMAGE 1 | IMAGE 0 | IMAGE 1 | IMAGE 0 | ··· | IMAGE 1 | IMAGE 0 | |
| | ··· | IMAGE 1 | IMAGE 0 | IMAGE 1 | IMAGE 0 | ··· | IMAGE 1 | IMAGE 0 | |
| | 480 | IMAGE 1 | IMAGE 0 | IMAGE 1 | IMAGE 0 | ··· | IMAGE 1 | IMAGE 0 | |
| | VB | | | | | | | | |
| FRAME 2 | 1 | IMAGE 2 | IMAGE 1 | IMAGE 2 | IMAGE 1 | ··· | IMAGE 2 | IMAGE 1 | |
| | ··· | IMAGE 2 | IMAGE 1 | IMAGE 2 | IMAGE 1 | ··· | IMAGE 2 | IMAGE 1 | |
| | ··· | IMAGE 2 | IMAGE 1 | IMAGE 2 | IMAGE 1 | ··· | IMAGE 2 | IMAGE 1 | |
| | 480 | IMAGE 2 | IMAGE 1 | IMAGE 2 | IMAGE 1 | ··· | IMAGE 2 | IMAGE 1 | |
| | VB | | | | | | | | |
| FRAME 3 | 1 | IMAGE 3 | IMAGE 2 | IMAGE 3 | IMAGE 2 | ··· | IMAGE 3 | IMAGE 2 | |
| | ··· | IMAGE 3 | IMAGE 2 | IMAGE 3 | IMAGE 2 | ··· | IMAGE 3 | IMAGE 2 | |
| | ··· | IMAGE 3 | IMAGE 2 | IMAGE 3 | IMAGE 2 | ··· | IMAGE 3 | IMAGE 2 | |
| | 480 | IMAGE 3 | IMAGE 2 | IMAGE 3 | IMAGE 2 | ··· | IMAGE 3 | IMAGE 2 | |
| | VB | | | | | | | | |
| FRAME 4 | 1 | IMAGE 4 | IMAGE 3 | IMAGE 4 | IMAGE 3 | ··· | IMAGE 4 | IMAGE 3 | |
| | ··· | IMAGE 4 | IMAGE 3 | IMAGE 4 | IMAGE 3 | ··· | IMAGE 4 | IMAGE 3 | |
| | ··· | IMAGE 4 | IMAGE 3 | IMAGE 4 | IMAGE 3 | ··· | IMAGE 4 | IMAGE 3 | |
| | 480 | IMAGE 4 | IMAGE 3 | IMAGE 4 | IMAGE 3 | ··· | IMAGE 4 | IMAGE 3 | |
| | VB | | | | | | | | |

FIG. 9

| | | | | | | |
|---|---|---|---|---|---|---|
| | | 1 | 2 | ··· | 640 | HB |
| FRAME 1 | 1 | IMAGE 1 | | | | |
| | 2 | IMAGE 1 | | | | |
| | 3 | IMAGE 0 | | | | |
| | 4 | IMAGE 0 | | | | |
| | ··· | ··· | | | | |
| | 957 | IMAGE 1 | | | | |
| | 958 | IMAGE 1 | | | | |
| | 959 | IMAGE 0 | | | | |
| | 960 | IMAGE 0 | | | | |
| | VB | | | | | |
| | | 1 | 2 | ··· | 640 | HB |
| FRAME 2 | 1 | IMAGE 2 | | | | |
| | 2 | IMAGE 2 | | | | |
| | 3 | IMAGE 1 | | | | |
| | 4 | IMAGE 1 | | | | |
| | ··· | ··· | | | | |
| | 957 | IMAGE 2 | | | | |
| | 958 | IMAGE 2 | | | | |
| | 959 | IMAGE 1 | | | | |
| | 960 | IMAGE 1 | | | | |
| | VB | | | | | |
| | | 1 | 2 | ··· | 640 | HB |

FIG. 15

| | | | | 1 | 2 | ··· | 640 | 641 | 642 | ··· | 1280 | HB |
|---|---|---|---|---|---|---|---|---|---|---|---|---|
| ONE FRAME PERIOD | ONE SUB-FRAME PERIOD | ONE SUB-SUB-FRAME PERIOD | 1 | RED IMAGE 1 | | | | BLUE IMAGE 0 | | | | |
| | | | ··· | | | | | | | | | |
| | | | ··· | | | | | | | | | |
| | | | 480 | | | | | | | | | |
| | | | VB | | | | | | | | | |
| | | ONE SUB-SUB-FRAME PERIOD | 1 | RED IMAGE 1 | | | | BLUE IMAGE 0 | | | | |
| | | | ··· | | | | | | | | | |
| | | | ··· | | | | | | | | | |
| | | | 480 | | | | | | | | | |
| | | | VB | | | | | | | | | |
| | ONE SUB-FRAME PERIOD | ONE SUB-SUB-FRAME PERIOD | 1 | GREEN IMAGE 1 | | | | RED IMAGE 1 | | | | |
| | | | ··· | | | | | | | | | |
| | | | ··· | | | | | | | | | |
| | | | 480 | | | | | | | | | |
| | | | VB | | | | | | | | | |
| | | ONE SUB-SUB-FRAME PERIOD | 1 | GREEN IMAGE 1 | | | | RED IMAGE 1 | | | | |
| | | | ··· | | | | | | | | | |
| | | | ··· | | | | | | | | | |
| | | | 480 | | | | | | | | | |
| | | | VB | | | | | | | | | |
| | ONE SUB-FRAME PERIOD | ONE SUB-SUB-FRAME PERIOD | 1 | BLUE IMAGE 1 | | | | GREEN IMAGE 1 | | | | |
| | | | ··· | | | | | | | | | |
| | | | ··· | | | | | | | | | |
| | | | 480 | | | | | | | | | |
| | | | VB | | | | | | | | | |
| | | ONE SUB-SUB-FRAME PERIOD | 1 | BLUE IMAGE 1 | | | | GREEN IMAGE 1 | | | | |
| | | | ··· | | | | | | | | | |
| | | | ··· | | | | | | | | | |
| | | | 480 | | | | | | | | | |
| | | | VB | | | | | | | | | |
| | ONE SUB-FRAME PERIOD | ONE SUB-SUB-FRAME PERIOD | 1 | RED IMAGE 2 | | | | BLUE IMAGE 1 | | | | |
| | | | ··· | | | | | | | | | |
| | | | ··· | | | | | | | | | |
| | | | 480 | | | | | | | | | |
| | | | VB | | | | | | | | | |
| | | ONE SUB-SUB-FRAME PERIOD | 1 | RED IMAGE 2 | | | | BLUE IMAGE 1 | | | | |
| | | | ··· | | | | | | | | | |
| | | | ··· | | | | | | | | | |
| | | | 480 | | | | | | | | | |
| | | | VB | | | | | | | | | |

FIG. 20

| | | | | 1 | 2 | … | 640 | 641 | 642 | … | 1280 | HB |
|---|---|---|---|---|---|---|---|---|---|---|---|---|
| ONE FRAME PERIOD | ONE SUB-FRAME PERIOD | ONE SUB-SUB-FRAME PERIOD | 1 | LEFT IMAGE 1 | | | | RIGHT IMAGE 0 | | | | |
| | | | … | | | | | | | | | |
| | | | … | | | | | | | | | |
| | | | 480 | | | | | | | | | |
| | | | VB | | | | | | | | | |
| | | ONE SUB-SUB-FRAME PERIOD | 1 | LEFT IMAGE 1 | | | | RIGHT IMAGE 0 | | | | |
| | | | … | | | | | | | | | |
| | | | … | | | | | | | | | |
| | | | 480 | | | | | | | | | |
| | | | VB | | | | | | | | | |
| | ONE SUB-FRAME PERIOD | ONE SUB-SUB-FRAME PERIOD | 1 | LEFT IMAGE 1 | | | | RIGHT IMAGE 1 | | | | |
| | | | … | | | | | | | | | |
| | | | … | | | | | | | | | |
| | | | 480 | | | | | | | | | |
| | | | VB | | | | | | | | | |
| | | ONE SUB-SUB-FRAME PERIOD | 1 | LEFT IMAGE 1 | | | | RIGHT IMAGE 1 | | | | |
| | | | … | | | | | | | | | |
| | | | … | | | | | | | | | |
| | | | 480 | | | | | | | | | |
| | | | VB | | | | | | | | | |
| ONE FRAME PERIOD | ONE SUB-FRAME PERIOD | ONE SUB-SUB-FRAME PERIOD | 1 | LEFT IMAGE 2 | | | | RIGHT IMAGE 1 | | | | |
| | | | … | | | | | | | | | |
| | | | … | | | | | | | | | |
| | | | 480 | | | | | | | | | |
| | | | VB | | | | | | | | | |
| | | ONE SUB-SUB-FRAME PERIOD | 1 | LEFT IMAGE 2 | | | | RIGHT IMAGE 1 | | | | |
| | | | … | | | | | | | | | |
| | | | … | | | | | | | | | |
| | | | 480 | | | | | | | | | |
| | | | VB | | | | | | | | | |
| | ONE SUB-FRAME PERIOD | ONE SUB-SUB-FRAME PERIOD | 1 | LEFT IMAGE 2 | | | | RIGHT IMAGE 2 | | | | |
| | | | … | | | | | | | | | |
| | | | … | | | | | | | | | |
| | | | 480 | | | | | | | | | |
| | | | VB | | | | | | | | | |
| | | ONE SUB-SUB-FRAME PERIOD | 1 | LEFT IMAGE 2 | | | | RIGHT IMAGE 2 | | | | |
| | | | … | | | | | | | | | |
| | | | … | | | | | | | | | |
| | | | 480 | | | | | | | | | |
| | | | VB | | | | | | | | | |

IMAGE DISPLAY SYSTEM WHICH PERFORMS OVERDRIVE PROCESSING

BACKGROUND OF THE INVENTION

1. Field of the Invention

The present invention relates to an image display system, in particular, an image display system in which an image display device performs overdrive processing.

2. Description of the Background Art

With regard to a conventional liquid crystal display device, there has been well known the following disadvantage. That is, upon display of a moving image, a moving image blurring phenomenon occurs due to a factor of motion of a liquid crystal molecule, a factor of a drive method (hold type display) by which a single image is displayed continuously during one frame period, or the like.

The factor of the motion of the liquid crystal molecule is caused by the following two reasons. One of the reasons is that the liquid crystal molecule moves slowly due to its viscosity. The other reason is that in a case where the liquid crystal display device is driven by an active element such as a TFT (Thin-Film Transistor), a direction of a liquid crystal at a point in time when a pixel is charged varies after a while, resulting in variation in dielectric constant of the liquid crystal and variation in effective voltage. In order to deal with the phenomenon occurring due to this factor, the conventional liquid crystal display device adopts an overdrive processing technique.

Herein, overdrive processing refers to a technique of using information about a state of a liquid crystal at a point in time when a pixel is charged and information about an image to be displayed subsequently, in order to apply a voltage for bringing, to an optimum state, motion of the liquid crystal during a period that the liquid crystal is charged and then is charged again.

In order to deal with the phenomenon occurring due to the factor of the hold type display, on the other hand, the conventional liquid crystal display device adopts various techniques such as a blinking backlight method by which a backlight shut-off period is provided, a black insertion method by which a black display period is provided, and a frame interpolation and high-speed drive method by which an image between original image frames is generated and displayed at a frequency faster than a frame frequency of an original image.

As another drive method, the liquid crystal display device also adopts a field sequential drive method by which red backlight, green backlight, blue backlight and the like are emitted sequentially to change display by the liquid crystal display device from monochrome display to color display in a timeshared manner. As still another drive method, the liquid crystal display device also adopts a directivity scan backlight method by which backlight having special directivity is emitted sequentially in a specific direction and then the liquid crystal display device is driven in a timeshared manner in synchronization with the emission of the backlight to display an image which changes depending on a direction of view or to display a three-dimensional image. However, these methods are not pertain to solution of the problem of the moving image blurring phenomenon.

In the frame interpolation and high-speed drive method, the field sequential drive method or the directivity scan backlight method, the liquid crystal display device is driven at a high speed with respect to a frame cycle (normally, about 60 Hz) of an original image. In other words, when the liquid crystal display device is driven at a high speed, the frame period becomes short. Consequently, the liquid crystal molecule must be moved in a desired direction within the frame period. In order to satisfy this request, the liquid crystal display device frequently adopts the overdrive processing together with the foregoing drive method.

Japanese Patent Application Laid-Open Nos. 2004-304390 and 2003-143556 disclose examples of an image display device that adopts the overdrive processing.

In order to perform the overdrive processing, the image display device must grasp a state of a liquid crystal molecule at a point in time when a pixel is charged. Herein, the image display device requires at least information about image data in a preceding frame or information about a state of the liquid crystal molecule in the preceding frame. In order to determine an optimum drive voltage, alternatively, the image display device holds plural pieces of information over plural frame periods rather than information in one frame. That is, in order to perform the overdrive processing, the image display device requires at least information in a preceding frame and, therefore, must be provided with a frame delay circuit having a frame memory.

For example, input image data is inputted to each of a frame delay circuit and a LUT (Look Up Table). Based on the received input image data and the input image data sent from the frame delay circuit, the LUT generates and outputs image data corresponding to a predetermined applied voltage. Occasionally, the LUT obtains the image data by a function rather than a table. Moreover, the LUT changes a value of the image data depending on an ambient temperature.

Herein, consideration is given to an image display system including an image display device that includes an overdrive processing circuit and an image generation device that generates image data and transfers the image data to the image display device. The image generation device, which generates image data, includes a graphic memory. The graphic memory is used for rendering graphics, image data sent from a camera or a scanner, received broadcast video, and the like. The image display system described above requires two memories, that is, the graphic memory in the image generation device and a frame memory in the image display device, leading to increase in cost as a whole.

In each of image display systems disclosed in Japanese Patent Application Laid-Open Nos. 2004-304390 and 2003-143556, an image generation device has an overdrive processing function. Thus, the image display system allows reduction in memory cost as a whole. Herein, each of the image display systems disclosed in Japanese Patent Application Laid-Open Nos. 2004-304390 and 2003-143556 performs interlace-progressive conversion.

Frequently, the image generation device and the image display device are manufactured by different makers, respectively. In each of the image display systems disclosed in Japanese Patent Application Laid-Open Nos. 2004-304390 and 2003-143556, if the maker of the image display device is changed, setting values for the overdrive processing must be adjusted. In order to make fine adjustment such as change in setting values for overdrive processing depending on temperature, preferably, the image display system has a configuration that the image display device has the overdrive processing function, unlike the image display systems disclosed in Japanese Patent Application Laid-Open Nos. 2004-304390 and 2003-143556.

SUMMARY OF THE INVENTION

An object of the present invention is to provide an image display system that includes an image display device having an overdrive processing circuit and allows reduction in memory cost as a whole.

According to one aspect of the present invention, an image display system includes an image generation device that generates image data, and an image display device that receives the image data from the image generation device, performs overdrive processing based on the received image data, and displays an image. Herein, the image generation device includes a rendering circuit that generates image data to be outputted to the image display device for every frame, a memory unit that holds the plural pieces of image data corresponding to at least two frames among the plural pieces of image data generated by the rendering circuit, and a transfer circuit that transfers the plural pieces of image data corresponding to two frames among the plural pieces of image data held by the memory unit to the image display device within one frame period. The image display device receives the plural pieces of image data corresponding to the two frames from the transfer circuit and performs the overdrive processing based on the received image data.

In the image display system according to this aspect of the present invention, the image generation device includes the rendering circuit, the memory unit that holds plural pieces of image data corresponding to at least two frames, and the transfer circuit that transfers the plural pieces of image data corresponding to two frames to the image display device within one frame period, and the image display device receives the plural pieces of image data corresponding to the two frames from the transfer circuit and performs the overdrive processing based on the received image data. Therefore, this image display system allows reduction in memory cost as a whole while maintaining display quality.

These and other objects, features, aspects and advantages of the present invention will become more apparent from the following detailed description of the present invention when taken in conjunction with the accompanying drawings.

BRIEF DESCRIPTION OF THE DRAWINGS

FIG. 5 shows an image data format according to the first embodiment of the present invention;

FIG. 7 shows another image data format according to the first embodiment of the present invention;

FIG. 8 shows still another image data format according to the first embodiment of the present invention;

FIG. 9 shows yet another image data format according to the first embodiment of the present invention;

FIG. 15 shows another image data format according to the second embodiment of the present invention;

FIG. 20 shows an image data format according to the third embodiment of the present invention;

DESCRIPTION OF THE PREFERRED EMBODIMENTS (First Embodiment)

Figure 1:
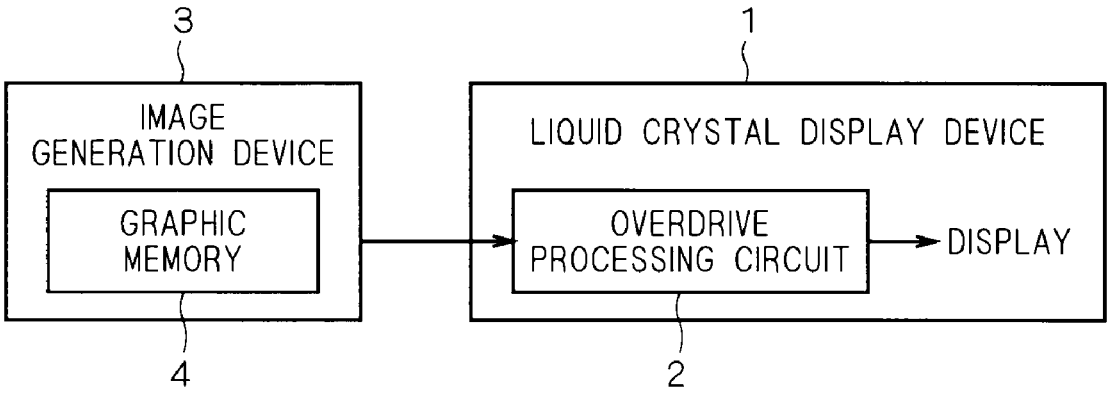
FIG. 1 shows a block diagram of an image display system according to a first embodiment of the present invention.

FIG. 1 shows a block diagram of an image display system according to a first embodiment of the present invention. As shown in FIG. 1, a liquid crystal display device 1 is described as an image display device; however, the present invention is not limited thereto. Herein, other image display devices may be used as long as they have an overdrive processing function. The liquid crystal display device 1 has a resolution of 640 by 480 pixels, and each pixel consists of data of 24 bits (8-bit red data, 8-bit green data and 8-bit blue data). Moreover, the liquid crystal display device 1 includes an overdrive processing circuit 2 and adjusts a voltage to be applied to the pixel. As shown in FIG. 1, also, an image generation device 3 includes a graphic memory 4 and transfers generated image data to the liquid crystal display device 1.

Figure 21:
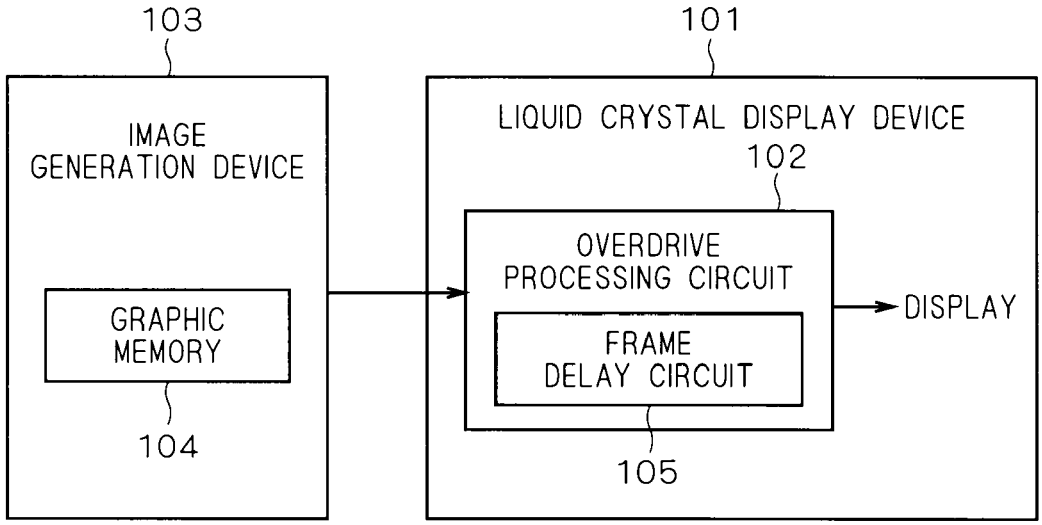
FIG. 21 shows a block diagram of an image display system which is a presupposition for the present invention.

With reference to FIG. 21, herein, description will be given of a conventional image display system. FIG. 21 shows a block diagram of the conventional image display system. In the image display system shown in FIG. 21, a liquid crystal display device 101 includes an overdrive processing circuit 102 and an image generation device 103 includes a graphic memory 104. Further, the overdrive processing circuit 102 includes a frame delay circuit 105.

Figure 22:
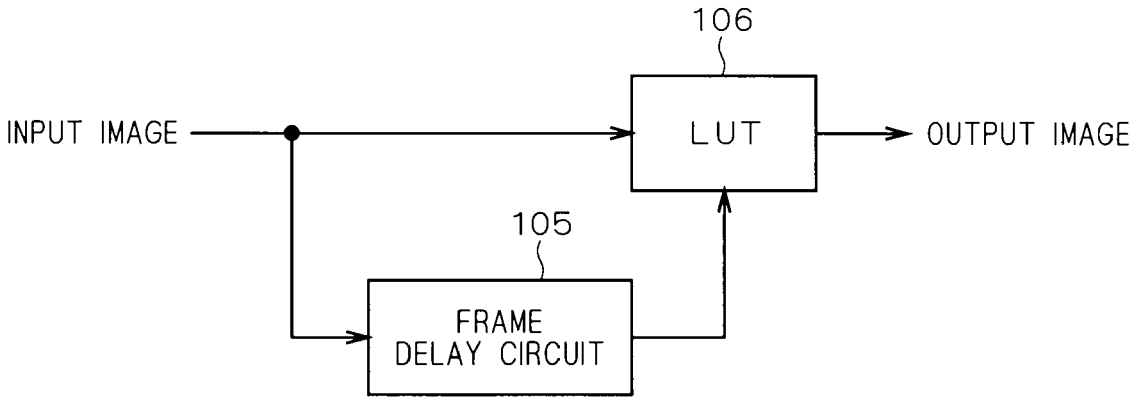
FIG. 22 shows a block diagram of an overdrive processing circuit which is a presupposition for the present invention.

With reference to FIG. 22, next, detailed description will be given of the overdrive processing circuit 102. FIG. 22 schematically shows the overdrive processing circuit 102. The overdrive processing circuit 102 includes a LUT 106 in addition to the frame delay circuit 105. Herein, an input image is inputted to each of the LUT 106 and the frame delay circuit 105. Based on the received input image and the input image sent from the frame delay circuit 105, the LUT 106 outputs an output image corresponding to a voltage to be applied to a pixel.

Figure 23:
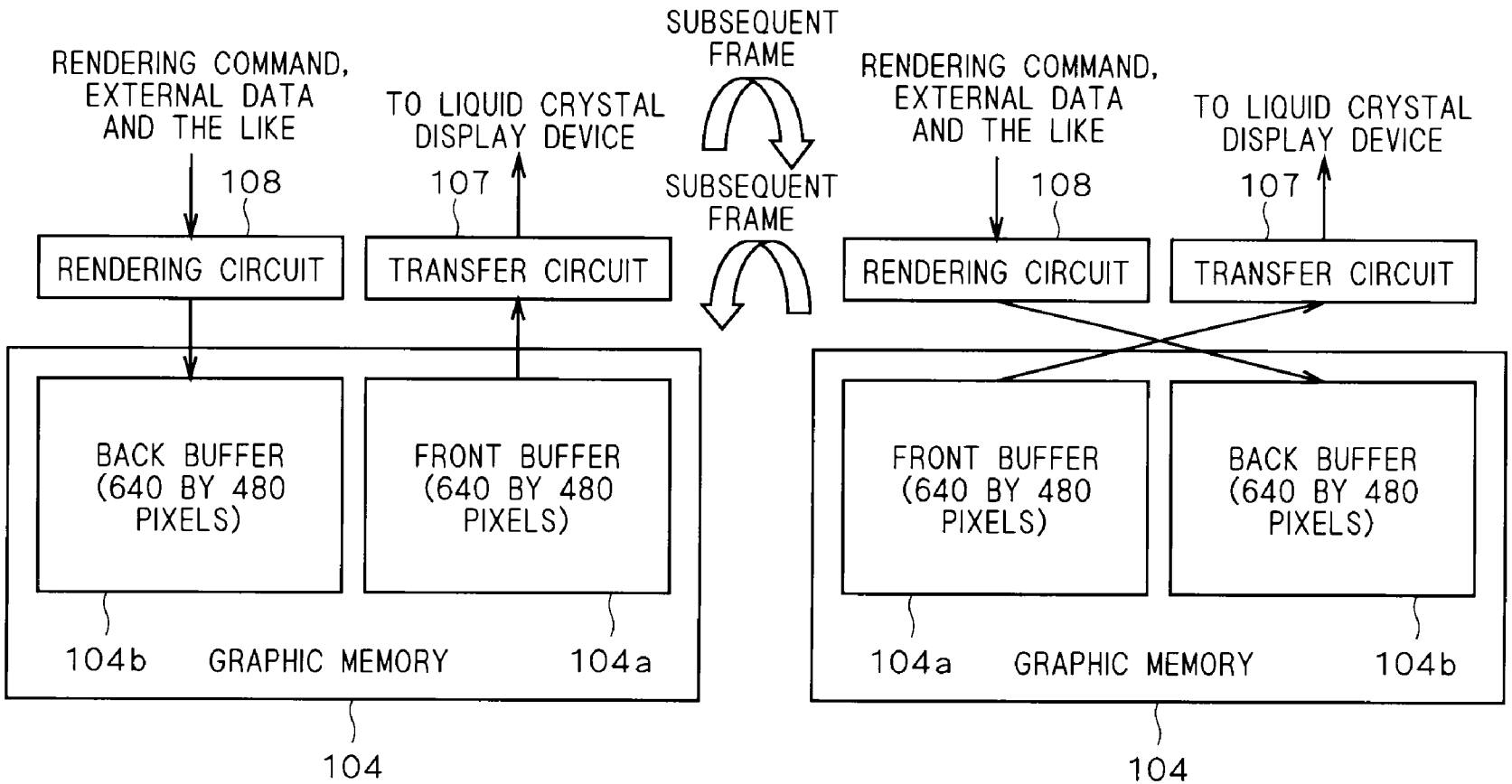
FIG. 23 shows a block diagram of an image generation device which is a presupposition for the present invention.

With reference to FIG. 23, next, description will be given of an image generation part and an image transfer part in the image generation device 103. FIG. 23 schematically shows the image generation device 103. Normally, the graphic memory 104 is divided into two regions, that is, a front buffer 104*a* and a back buffer 104*b*. The front buffer 104*a* is used for transfer of an image. At a timing that an image is transferred to the liquid crystal display device 101, a transfer circuit 107 sequentially reads and transfers plural pieces of image data. In a case of analog output, the image data is transferred after being subjected to D/A conversion. Occasionally, the image data is transferred after being converted into a digitized differential serial signal.

During a period that image data is transferred from the front buffer 104*a*, different image data is written to the front buffer 104*a*. In such a case, a preceding frame image and a new frame image are displayed together depending on a timing that the image data is written and a place where the image data is written. In order to avoid this case, the image data is written to the back buffer 104*b* through a rendering circuit 108. After completion of the write of the image data to the back buffer 104*b*, the back buffer 104*b* is switched to the front buffer 104*a* in a subsequent frame while the front buffer 104*a* is switched to the back buffer 104*b* in the subsequent frame (hereinafter, such an operation is referred to as "flip"). With this flip, image data in an actual memory region is not transferred, but a memory address to be controlled by the rendering circuit 108 and the transfer circuit 107 is exchanged. If the preceding frame image and the new frame image are not displayed together, the image data is written to the front buffer 104*a*; therefore, the back buffer 104*b* is not used.

If the write of the image data to the back buffer 104*b* is not completed within one frame or if the relevant frame does not require the write of the image data to the back buffer 104*b*, the flip is not performed. As a result, the same image data is transferred in a subsequent frame. If plural back buffers 104*b* are provided and the rendering circuit 108 has an allowance, plural pieces of image data are rendered in the back buffers 104*b*, and then the back buffers 104*b* are sequentially switched to the front buffer 104*a*. Normally, each of the front buffer 104*a* and the back buffer 104*b* has a size equal to a memory region corresponding to 640 by 480 pixels in the liquid crystal display device 101.

Figure 2:
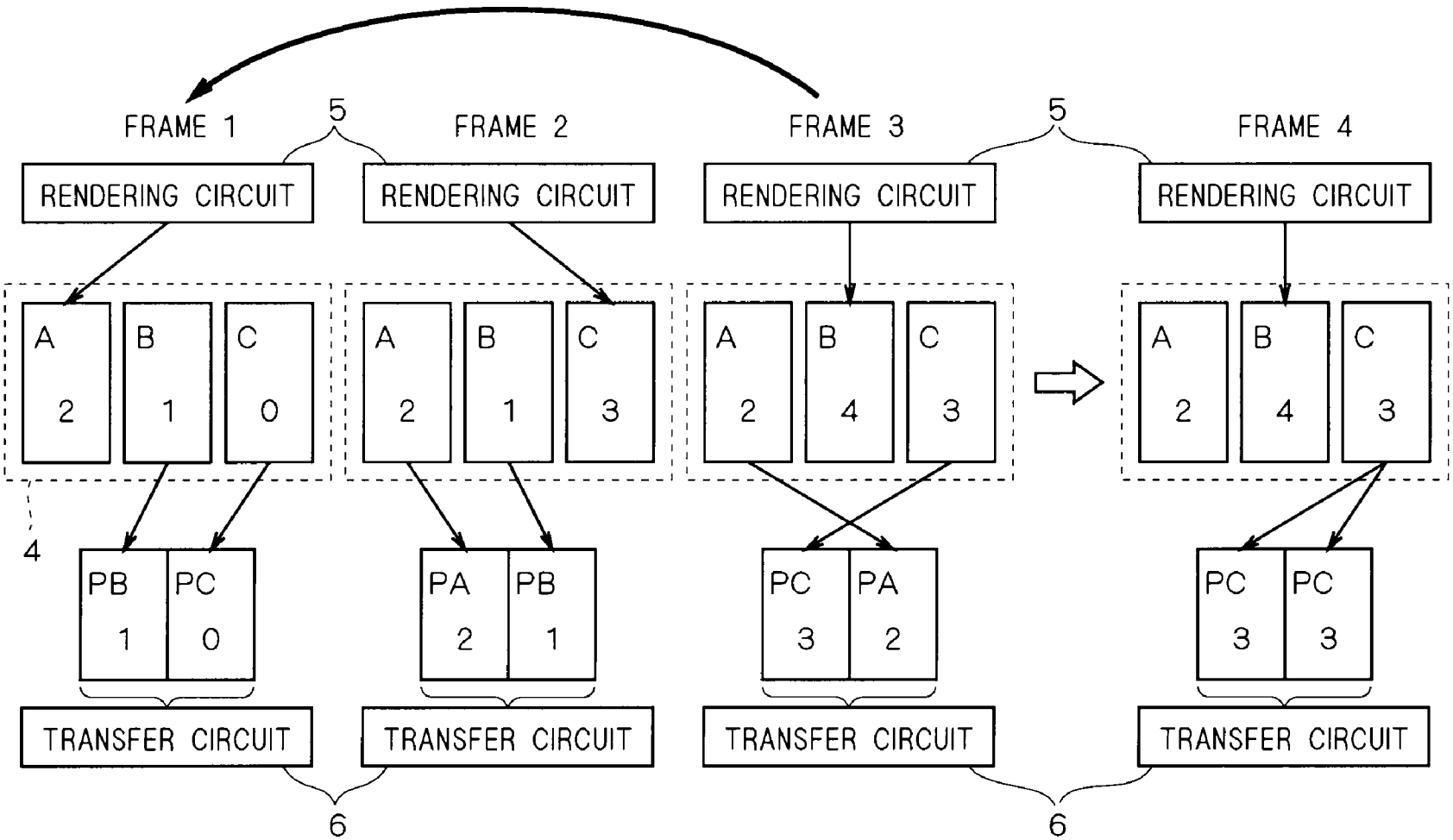
FIG. 2 shows a block diagram of an image generation device according to the first embodiment of the present invention.

With reference to FIG. 2, in contrast, description will be given of an image generation part and an image transfer part in the image generation device 3 according to the first embodiment. FIG. 2 schematically shows a configuration of the image generation device 3. Unlike the graphic memory 104 divided into the front buffer 104*a* and the back buffer 104*b* shown in FIG. 23, the graphic memory 4 shown in FIG. 2 has three memory blocks each corresponding to 640 by 480 pixels. For identification, the three memory blocks are shown with symbols "A", "B" and "C" in FIG. 2. As shown in FIG. 2, in a frame 1, a rendering circuit 5 writes image data to the memory block A (back buffer). Herein, a numeral described in each memory block denotes an order of image data written to the relevant memory block. In the frame 1, image data written to the memory block B is image data written in a frame preceding the frame 1, and image data in the memory block C is image data written in a frame preceding the frame in which the image data is written to the memory block B.

In the frame 1, a transfer circuit 6 outputs the plural pieces of image data in the memory blocks B and C (front buffers) to the liquid crystal display device 1. Herein, blocks shown with symbols "PB" and "PC" are memory addresses designated by the transfer circuit 6, and entities of memories exist in the memory blocks B and C.

In a subsequent frame 2, the rendering circuit 5 writes image data (3) to the memory block C while the transfer circuit 6 outputs the plural pieces of image data in the memory blocks A and B to the liquid crystal display device 1. In a frame 3, the rendering circuit 5 writes image data (4) to the memory block B while the transfer circuit 6 outputs the plural pieces of image data in the memory blocks C and A to the liquid crystal display device 1. In a frame 4, an operation equal to that in the frame 1 is performed.

It is assumed herein that no image data is written to the memory block B in the frame 3 or the write of the image data is not completed in the frame 3. In this case, unlike the case in the frame 1, the transfer circuit 6 does not select the left block indicating the memory address of the transfer circuit 6 as the memory block B in the frame 4 which is shown at a rightmost side of FIG. 2, but selects the left block as the memory block C in the frame 4. As a sequence, the block is switched only in a case where the flip is performed on the left block of the transfer circuit 6, and the transfer circuit 6 selects, as the right block, the block selected as the left block in the preceding frame.

Figure 3:
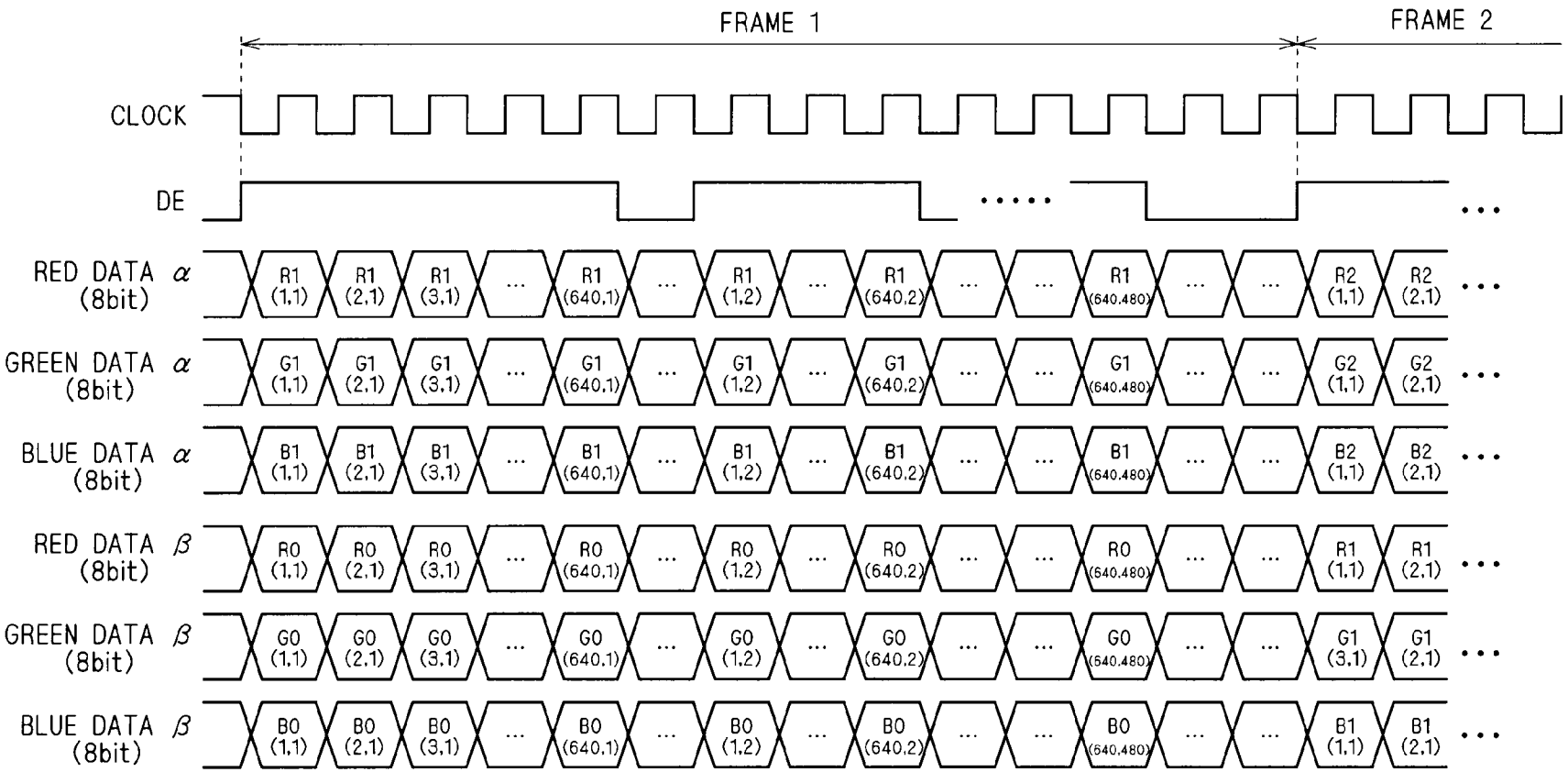
FIG. 3 shows a timing chart of image data according to the first embodiment of the present invention.

With reference to FIG. 3, next, detailed description will be given of an output signal from the transfer circuit 6. A clock signal shown in FIG. 3 is a timing reference signal such as data, and one set of data is transferred in one clock cycle. A DE signal shown in FIG. 3 indicates an effective period of data. A period that the DE signal is low corresponds to a horizontal blanking period or a vertical blanking period. In other words, image data corresponding to one row is transferred during a period that the DE signal becomes high once and then becomes low. In the first embodiment, one high period is 640 clock cycles. Herein, the number of times that the DE signal becomes high in one frame period denotes the number of rows. In the first embodiment, the number of rows is 480.

Normally, the transfer circuit 6 receives a vertical synchronizing signal and a horizontal synchronizing signal in addition to the DE signal. Alternatively, the transfer circuit 6 receives only the vertical synchronizing signal and the horizontal synchronizing signal. However, this configuration is not directly pertinent to the present invention; therefore, detailed description thereof will not be given here.

The DE signal has 8-bit red data $\alpha$, 8-bit green data $\alpha$ and 8-bit blue data $\alpha$ (24 bits in total) corresponding to image data. This image data equates to the image data written to the left block of the transfer circuit 6 shown in FIG. 2. In FIG. 3, symbols "R", "G" and "B" described in the respective pieces of image data denote red, green and blue, respectively, and numerals described next to the symbols "R", "G" and "B" equate to the numerals described in the blocks of the graphic memory 4 shown in FIG. 2. Also in FIG. 3, parenthesized numerals described in the respective pieces of image data denote an address of a displayed pixel. Herein, the left numeral denotes a column and the right numeral denotes a row. Three rows of data subsequent to the red data $\alpha$, the green data $\alpha$ and the blue data $\alpha$ are red data $\beta$, green data $\beta$ and blue data $\beta$. This image data equates to the image data written to the right block of the transfer circuit 6 shown in FIG. 2. Herein, the six rows of data, that is, the red data $\alpha$, the green data $\alpha$, the blue data $\alpha$, the red data $\beta$, the green data $\beta$ and the blue data $\beta$ are different from one another in an address of a block in the graphic memory 4 to be selected by the transfer circuit 6, but are equal to one another in an address of a displayed pixel.

Figure 4:
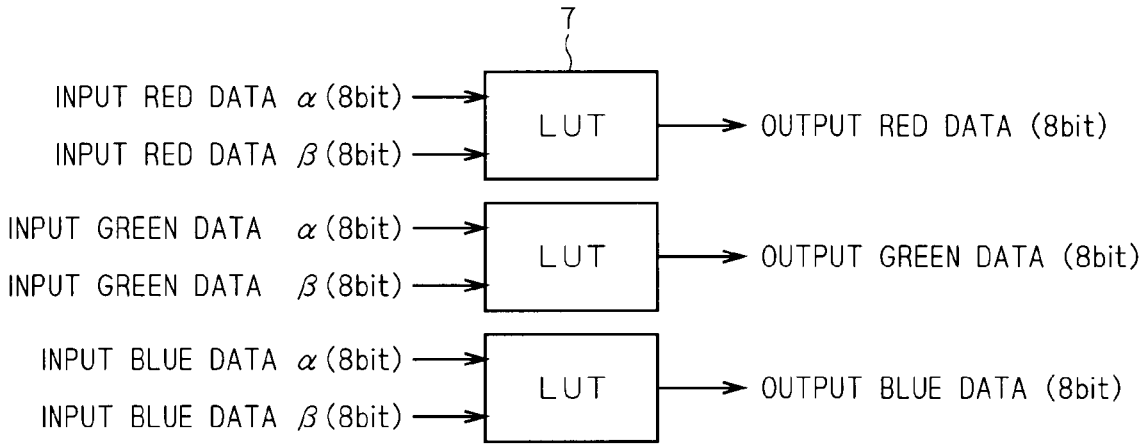
FIG. 4 shows a block diagram of an overdrive processing circuit according to the first embodiment of the present invention.

Upon reception of the image data shown in FIG. 3, next, the liquid crystal display device 1 performs the following processing. FIG. 4 schematically shows the processing performed by the overdrive processing circuit 2 of the liquid crystal display device 1. As shown in FIG. 4, a LUT 7 receives the red data $\alpha$ and the red data $\beta$, subjects each red data to addressing, and outputs new red data. The LUT 7 records red data corresponding to an applied voltage for obtaining an optimum display result from results of measurement of motion of a liquid crystal in one frame period in a case where a new voltage (corresponding to the red data $\alpha$) is applied to a state that a liquid crystal is charged (corresponding to the red data β). Normally, data is set at the applied voltage such that the applied voltage becomes high when the charged liquid crystal is changed from a dark state to a bright state while the voltage becomes low when the charged liquid crystal is changed from the bright state to the dark state. The same things hold true for the green data and the blue data. Typically, the LUT 7 has a single value for the red data, the green data and the blue data. However, color shift may occur on the course of the motion of the liquid crystal. In such a case, the LUT 7 may have different values for the red data, the green data and the blue data.

For simplification, in the example shown in FIG. 4, the LUT 7 has a size of 16 Mbits, that is, 8-bit output×8-bit input (data α)×8-bit input (data β), for every color; however, the present invention is not limited thereto. For example, in order to decrease a capacity of the LUT 7, the respective bits are thinned out, and output data may be calculated by a method such as linear interpolation. Further, the data in the LUT 7 is not stored as output data, but is stored as a value to be added to/subtracted from each color data α to be displayed next. Herein, a value obtained by the addition/subtraction described above may be calculated as output data. Alternatively, some parameters are held in place of the LUT 7. Then, the parameters and coefficients may be calculated by a polynomial using variables of data α and data β. Further, the motion of the liquid crystal varies largely depending on a temperature. Therefore, a temperature detection part may be provided additionally in order to change the value of the LUT 7 based on the detected value and to set optimum operating conditions. When a frame frequency varies, an arrival point of the liquid crystal after one frame varies. In order to avoid this disadvantage, a frame rate detection part is provided additionally to change the value of the LUT 7 based on the detected value and to set optimum operating conditions. In the first embodiment, further, the image data is transferred to the liquid crystal display device 1 with the use of the signal shown in FIG. 3; however, the present invention is not limited thereto. The image data may be transferred to the liquid crystal display device 1 after being serial converted into a high-speed differential signal such as LVDS (Low Voltage Differential Signaling). That is, the signal shown in FIG. 3 is set at the state before being converted into the high-speed differential signal. Upon transfer of the image data to the liquid crystal display device 1, any signal transfer methods may be used.

The image data subjected to the overdrive processing shown in FIG. 4 drives the liquid crystal display device 1 via a timing controller circuit that generates a control timing of each drive circuit in a matrix. The liquid crystal display device 1 according to the first embodiment is similar in configuration to a conventional liquid crystal display device except the overdrive processing circuit 2 described above; therefore, detailed description thereof will not be given here.

Next, description will be given of a modification of the transfer of the image data from the image generation device 3 to the liquid crystal display device 1. Image data consists of 8-bit red data, 8-bit green data and 8-bit blue data (24 bits in total). In the image display system according to the first embodiment, plural pieces of image data corresponding to two frames must be transferred. Therefore, a bus width requires 48 bits in order to transfer the plural pieces of image data corresponding to the two frames.

In order to secure the bus width of 48 bits, the number of lines must be increased. For this reason, the following modification may be considered as a method for reducing the bus width. Each color data β indicates a preceding state of a frame to be displayed. Therefore, when an image is switched in a preceding frame or a subsequent frame, each color data β affects display of the image. Normally, a human eye is not so high in precision with respect to a changing image. Therefore, no adverse influence is exerted on the display even when the number of bits of each color data β is reduced to some extent. Thus, in order to decrease the number of lines, the lower bits of the data β are reduced by several bits.

In a case where the transfer circuit 6 reads image data from the front buffer at a frequency equal to that of an output clock, the image generation device 3 requires one graphic memory 4 having a read bus width which is not less than 48 bits or two graphic memories 4 each having a read bus width which is not less than 24 bits. If a graphic memory 4 to be provided has a read bus width which falls within a range between not less than 24 bits and less than 48 bits, the transfer circuit 6 must read image data with a clock faster than the output clock.

Normally, a DRAM (Dynamic Random Access Memory) is used as the graphic memory 4. Therefore, the graphic memory 4 can perform burst read, but can not freely perform random read. In such a case, in the frame 1 shown in FIG. 2, the image data is read from the left block (e.g., the block PB in the frame 1 shown in FIG. 2) of the transfer circuit 6 which transfers the image data at a first line and, then, the image data is read from the right block (e.g., the block PC in the frame 1 shown in FIG. 2). Herein, this operation is performed repeatedly.

FIG. 5 specifically shows data to be transferred by this method. For facilitation of understanding, FIG. 5 shows an image data format in a matrix direction, unlike the timing chart shown in FIG. 3. In FIG. 5, data in a horizontal direction is shown in a lateral direction, and an effective image area has 1280 pixels. A symbol "HB" shown in FIG. 5 denotes a horizontal blanking period. Also in FIG. 5, data in a vertical direction is shown in a longitudinal direction, and the effective image area has 480 lines. A symbol "VB" shown in FIG. 5 denotes a vertical blanking period.

As shown in FIG. 5, the data in the pixel (1, 1) ((a horizontal position, a vertical position) in the frame 1), the data in the pixel (2, 1), . . . and the data in the pixel (1280, 1) are transferred sequentially. After a lapse of the HB period on the first line, the data in the pixel (1, 2), the data in the pixel (2, 2), . . . are transferred sequentially. In each frame, the effective image area is divided into two, that is, a left side and a right side. The plural pieces of image data in the graphic memory 4 selected as the left block of the transfer circuit 6 shown in FIG. 2 are transferred sequentially to the left side in the horizontal direction. On the other hand, the plural pieces of image data in the graphic memory 4 selected as the right block of the transfer circuit 6 shown in FIG. 2 are transferred sequentially to the right side in the horizontal direction.

In comparison with FIG. 3, the red data α, the green data α and the blue data α in the frame 1 shown in FIG. 3 equate to the image 1 in the left side shown in FIG. 5. On the other hand, the red data β, the green data β and the blue data β in the frame 1 shown in FIG. 3 equate to the image 0 in the right side shown in FIG. 5. Herein, a numeral described next to the term "image" (e.g., "1" of "image 1") equates to the numeral described in the block of the graphic memory 4 shown in FIG. 2.

In the foregoing example, the new data is transferred to the left side of the effective image area and the data in the preceding frame is transferred to the right side of the effective image area. On conditions preset between the image generation device 3 and the liquid crystal display device 1, the left and right sides may be reversed. Alternatively, the left and right sides are inverted for every frame.

Figure 6:
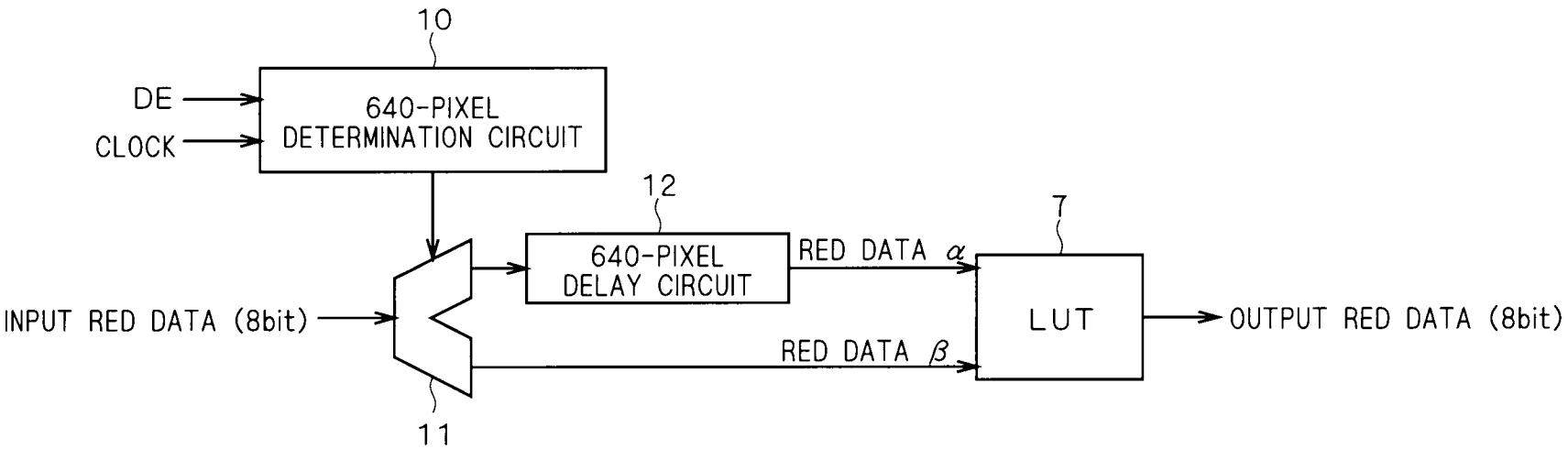
FIG. 6 shows a block diagram of another overdrive processing circuit according to the first embodiment of the present invention.

Upon reception of the image data having the format shown in FIG. 5 from the image generation device 3, the liquid crystal display device 1 performs the following processing. FIG. 6 schematically shows the internal processing performed by the liquid crystal display device 1. FIG. 6 shows only the processing for the red image data. However, the processing is similar to those for the green image data and the blue image data; therefore, description thereof will not be given repeatedly. As shown in FIG. 6, the overdrive processing circuit 2 further includes a 640-pixel determination circuit 10, a demultiplexer 11 and a 640-pixel delay circuit 12 in addition to the configuration shown in FIG. 4. The 640-pixel determination circuit 10 starts to count a clock when the DE signal shown in FIG. 3 becomes high, and selects one of the right side and the left side of the effective image area shown in FIG. 5. The demultiplexer 11 receives a signal from the 640-pixel determination circuit 10. In a case of the left side, the demultiplexer 11 sends the red data to the 640-pixel delay circuit 12. In a case of the right side, the demultiplexer 11 sends the red data to the LUT 7.

Thus, the demultiplexer 11 simultaneously inputs, to the LUT 7, the red data α through the 640-pixel delay circuit 12 and the red data β as red data in a single pixel. That is, the LUT 7 operates as shown in FIG. 4. Herein, the red data is outputted within the period of the right side shown in FIG. 5. Therefore, a clock frequency is almost twice as large as the clock frequency shown in FIG. 3 on the assumption that one frame period herein is equal to that in FIG. 3. If the clock frequency is too high in processing after the processing performed by the LUT 7, particularly, in processing performed by a column drive circuit, a delay part such as a FIFO may be provided to divide the clock frequency into halves after output of the red data. Alternatively, the 640-pixel delay circuit 12 shown in FIG. 6 may also be provided on the side of the red data β in order to simultaneously read the red data α and the red data β at a half clock frequency.

As described above, the image display system in the first embodiment requires no frame delay circuit such as the frame delay circuit 105 of the liquid crystal display device 101 shown in FIG. 21. Moreover, the liquid crystal display device 1 requires no memory unit having a large memory size such as the graphic memory 4 of the image generation device 3. Therefore, the image display system according to the first embodiment allows reduction in memory cost. The image generation device 3 includes the graphic memory 4 serving as a frame delay circuit. Normally, the graphic memory 4 is used for storing rendered data such as texture, in addition to the use as the front buffer and the back buffer. Therefore, the graphic memory 4 has a large capacity, but exerts almost no adverse influence on the memory cost.

Occasionally, the liquid crystal display device 1 requires a memory such as the 640-pixel delay circuit 12 shown in FIG. 6. Typically, such a memory is considerably smaller in capacity than a frame delay circuit in the form of a DRAM. Therefore, the memory can be prepared on a normal logic circuit (e.g., ASIC) and hardly exerts an influence on the memory cost.

In the image display system according to the first embodiment, an image data format is not limited to that shown in FIG. 5. If the transfer circuit 6 shown in FIG. 2 requires much time to selectively switch between the left side and the right side, a blanking period may be provided to the period of the selective switch so as to output image data in accordance with a format shown in FIG. 7. In the present invention, further, image data may be outputted from the image generation device 3 to the liquid crystal display device 1 in accordance with many formats shown in FIGS. 8 and 9. Herein, the image data format shown in FIG. 8 has a configuration that plural pieces of image data in different frames are switched and transferred for every pixel. The image data format shown in FIG. 9 has a configuration that plural pieces of image data in different frames are switched and transferred for every two rows. Herein, the image data transfer timing is not limited to two rows in the image data format shown in FIG. 9 as long as the image data is transferred for every plural rows.

The image display system according to the first embodiment has a feature in that a time interval between the timing that the red data α (or the green data α or the blue data α) shown in FIG. 4 is inputted to the liquid crystal display device 1 and the timing that the red data β (or the green data β or the blue data β) on a display pixel coordinate, which is equal to that of the red data α, is inputted to the liquid crystal display device 1 is short, so that a delay amount of the delay circuit in the liquid crystal display device 1 can be made smaller than that of the frame delay circuit. Therefore, the present invention is not limited to the foregoing example as long as the image generation device 3 is configured to realize this feature.

(Second Embodiment)

The liquid crystal display device 1 according to the first embodiment forms a color image by provision of the pixels corresponding to the red image data, the green image data and the blue image data. On the other hand, a liquid crystal display device 1 according to a second embodiment of the present invention forms a color image in such a manner that a monochrome liquid crystal panel is driven by a field sequential drive method. Herein, the field sequential drive method refers to a drive method of sequentially emitting red backlight, green backlight and blue backlight for every color, rewriting an image on the monochrome liquid crystal panel in synchronization with this light emission, and displaying the image as a color image.

Figure 10:
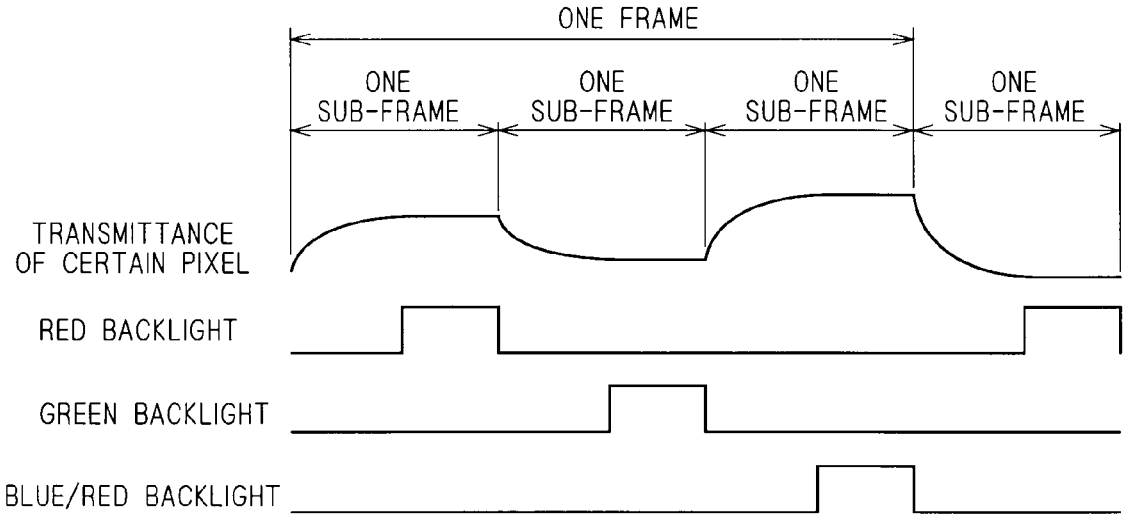
FIGS. 10 to 13 show a transmittance of a pixel and a timing of emission of backlight according to a second embodiment of the present invention, respectively.

Specifically, the liquid crystal display device 1 drives the monochrome liquid crystal panel in accordance with a timing chart shown in FIG. 10. That is, before emission of red backlight, a voltage is applied to a liquid crystal such that a certain pixel has a transmittance in accordance with red input signal data. The transmittance varies in accordance with the voltage applied to the liquid crystal, but does not vary in a rectangular waveform. Therefore, the red backlight is emitted at a timing that the liquid crystal becomes almost stable. Similarly, a voltage is applied to the liquid crystal such that the pixel has a transmittance in accordance with green input signal data. When the pixel has a desired transmittance, green backlight is emitted. The same things hold true for blue backlight. The three sub-frame units are defined as one frame (typically, about 60 Hz) to form one image.

Herein, all the pixels are not simultaneously written to a screen of the liquid crystal display device 1, but are sequentially written in a row unit from above. On the other hand, the backlight is emitted to the entire screen in the simplest configuration. However, the screen is divided into some areas by an optical configuration and the backlight may be sequentially emitted to the areas from above. That is, it is difficult to divide the liquid crystal panel into some areas for every row. If the liquid crystal panel can be divided, a configuration thereof becomes considerably complicated and, therefore, is not realistic. For this reason, typically, the backlight is emitted to a plurality of rows defined as one area.

In the second embodiment, for facilitation, description will be given of the backlight which is emitted to the entire screen. With reference to a timing chart shown in FIG. 11, when the write of the liquid crystal is performed sequentially over one sub-frame period, a pixel (upper pixel) which is written at an upper side of the screen has a desired transmittance until the backlight is emitted to the screen, but a pixel (lower pixel) which is written at a lower side of the screen is not written to the screen yet. For simplification, FIG. 11 shows an example that the backlight is emitted in only a first sub-frame (corresponding to red) of one frame.

Figure 11:
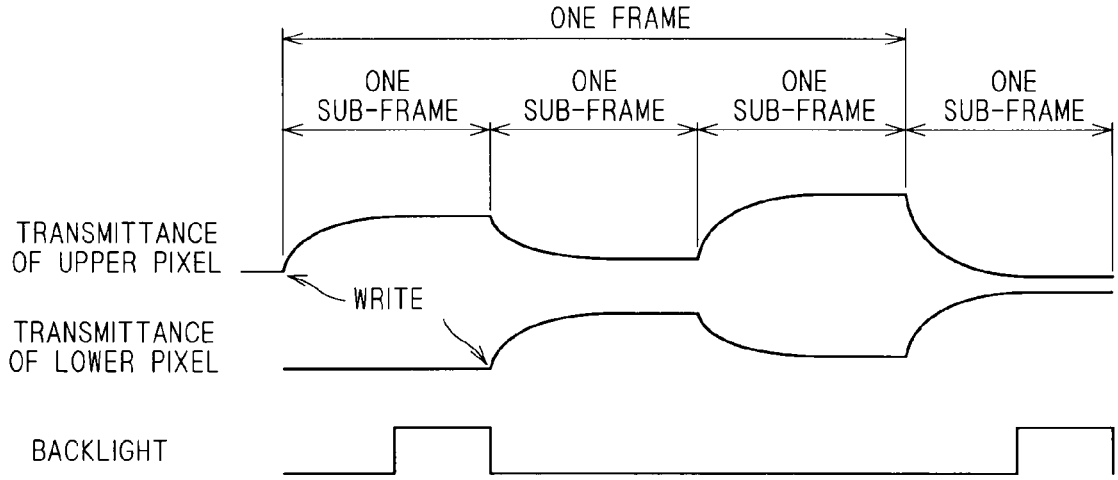

In order to avoid a time lag between the write of the upper pixel and the write of the lower pixel shown in the timing chart of FIG. 11, the following drive method must be adopted. With reference to a timing chart shown in FIG. 12, a liquid crystal write speed is increased so as to provide a period that all the pixels have a desired transmittance in one sub-frame (a liquid response stable period). However, the timing chart shown in FIG. 12 becomes shorter in backlight emission time than the timing chart shown in FIG. 10. In order to achieve a single average luminance in the liquid crystal display device 1, a large luminance is required instantaneously at the backlight emission time. Consequently, some improvements such as increase in number of light sources of backlight must be required. In order to prolong the backlight emission time, conversely, the liquid crystal write speed must be increased or the liquid crystal response speed must be increased.

For this reason, overdrive processing is adopted to the image display system in the second embodiment, which is driven by the field sequential drive method, in order to increase the response speed of the liquid crystal. Herein, the overdrive processing is equal to that described in the first embodiment. Moreover, the configuration of the image display system according to the second embodiment is basically equal to that shown in FIGS. 1 and 2; therefore, detailed description thereof will not be given here.

Figure 14:
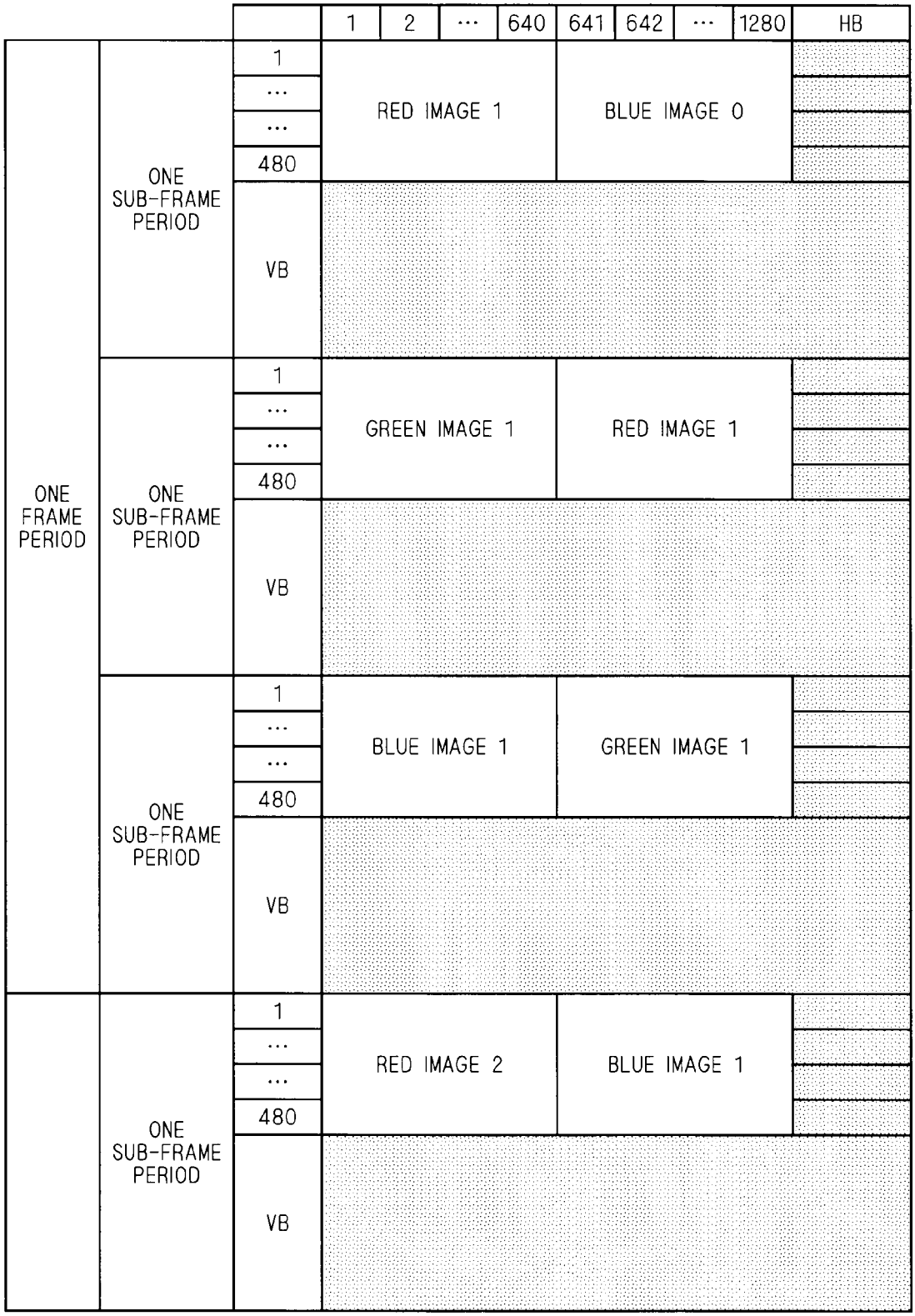
FIG. 14 shows an image data format according to the second embodiment of the present invention.

FIG. 14 shows a format of image data to be transferred from an image generation device 3 to the liquid crystal display device 1 in the image display system according to the second embodiment. The format shown in FIG. 14 corresponds to that shown in FIG. 5 in the first embodiment. However, the format shown in FIG. 14 is different from that shown in FIG. 5 in a point that one frame period is divided into three sub-frame periods because the field sequential drive method is adopted. Each sub-frame period is divided into two, that is, a left side and a right side as in the case of one frame period shown in FIG. 5, and corresponding image data is written to each side. In the first sub-frame period, more specifically, a red image 1 is written to the left side (1 to 640 pixels) and a red image 0, which has been written to the liquid crystal prior to the image 1, is written to the right side (641 to 1280 pixels).

In FIG. 5, the image data forming one pixel is 24 bits. In FIG. 14, on the other hand, the image data firming one pixel is 8 bits of a single color. Moreover, a transfer rate for every row unit is increased in accordance with the timing that the image data is written to the liquid crystal, so that a vertical blanking period is increased.

The configuration of the image generation device 3 according to the second embodiment is equal to that of the image generation device 3 according to the first embodiment. That is, a rendering circuit 5 is completely equal in operation to that in the first embodiment, and a transfer circuit 6 transfers image data for every single color at a timing shown in FIG. 14. On the other hand, the liquid crystal display device 1 is operated as shown in FIG. 6. However, the data forming one pixel has only 8 bits. Therefore, the liquid crystal display device 1 does not require circuits for three colors as shown in FIG. 4, but requires only one circuit. With this configuration, in the image display system in the second embodiment, which adopts the field sequential drive method, the liquid crystal display device 1 requires no frame delay circuit, leading to reduction in memory cost as a whole.

Figure 12:
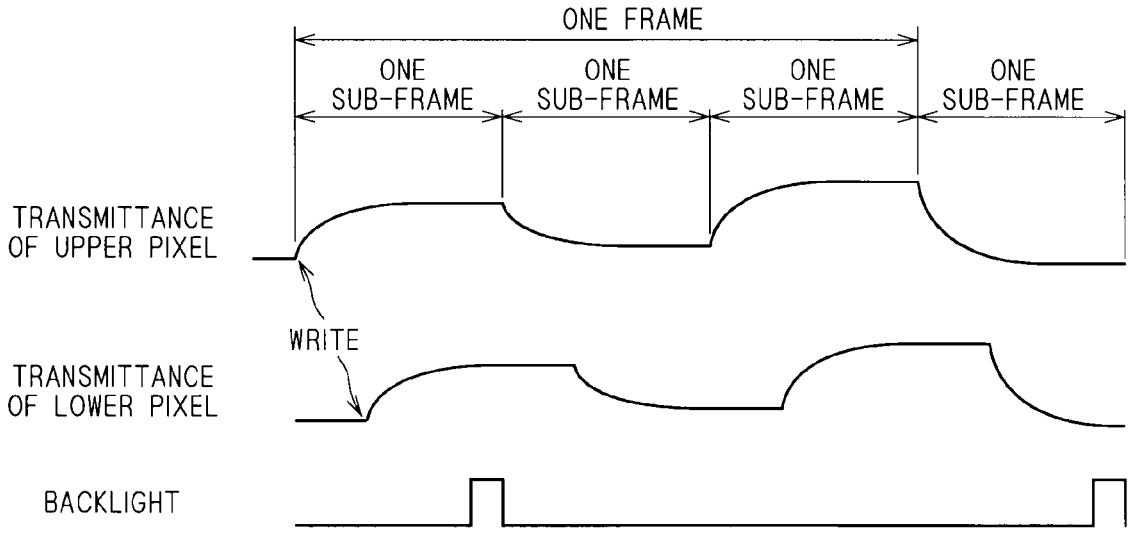

If the response of the liquid crystal is slow, the lower pixel fails to respond to a timing of emission of backlight shown in FIG. 12; therefore, the timing must be further shortened. In order to make the liquid crystal response quick, a higher overvoltage must be applied to the liquid crystal by the overdrive processing. However, if the high overvoltage is applied to the liquid crystal, the transmittance of the upper pixel exceeds a desired value. Consequently, the upper and lower pixels are different in luminance from each other. In order to eliminate the difference, one sub-frame is further divided into two, and the liquid crystal display device 1 drives the liquid crystal panel in accordance with a timing chart shown in FIG. 13.

Figure 13:
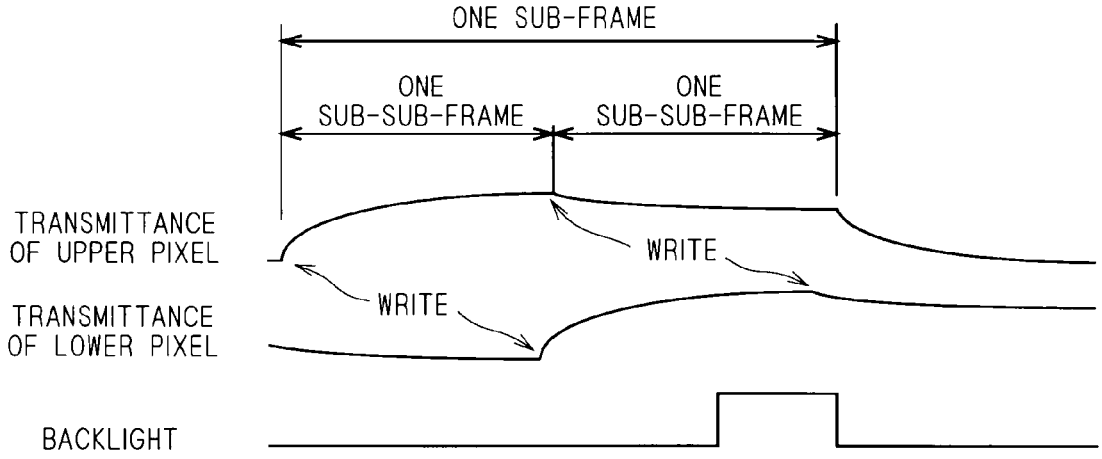

In the timing chart shown in FIG. 13, one sub-frame period shown in FIG. 12 is further divided into two (each referred to as "sub-sub-frame" in FIG. 13), and the write of the pixel is performed on each period as in the case of the one sub-frame period shown in FIG. 12. In the first sub-sub-frame period, a relatively high overdrive voltage is applied to the liquid crystal. In the second sub-sub-frame period, then, a voltage for obtaining a target transmittance is applied to the liquid crystal. If the voltage applied in the first overdrive processing is low, a voltage exceeding the voltage for obtaining the target transmittance may be applied to the liquid crystal in the second overdrive processing. When the liquid crystal display device 1 drives the liquid crystal panel in accordance with the timing chart shown in FIG. 13, the response of the liquid crystal is made quick in such a manner that the relatively high overvoltage is applied to the liquid crystal in the first sub-sub-frame period and, then, the state of the liquid crystal is stabilized in such a manner that the voltage for obtaining the target transmittance is applied to the liquid crystal in the second sub-sub-frame period. Thus, the difference in luminance between the upper pixel and the lower pixel can be made small.

For this drive method, image data is transferred to the liquid crystal display device 1 in accordance with an image data format shown in FIG. 15. The image data format shown in FIG. 15 is basically equal to that shown in FIG. 14. As shown in FIG. 15, one sub-frame period is divided into two sub-sub-frame periods, and image data to be transferred in the first sub-sub-frame period is equal to image data to be transferred in the second sub-sub-frame period. In the second embodiment, the transfer circuit 6 of the image generation device 3 transfers image data in accordance with the sequence shown in FIG. 13 at the timing shown in FIG. 15. However, the rendering circuit 5 in the second embodiment is identical with that in the first embodiment.

Figure 16:
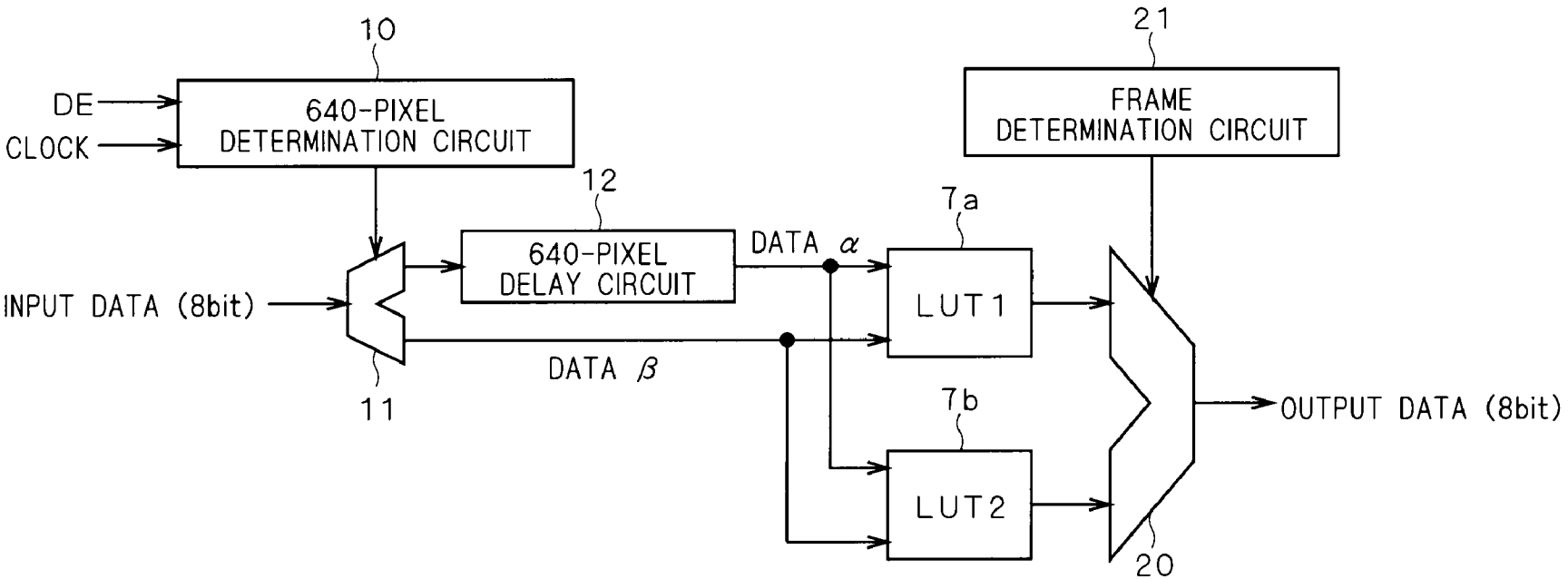
FIG. 16 shows a block diagram of an overdrive processing circuit according to the second embodiment of the present invention.

With reference to FIG. 16, next, description will be given of a configuration of the liquid crystal display device 1 that receives the image data having the image data format shown in FIG. 15. The configuration shown in FIG. 16 is different from that shown in FIG. 6 in a point that two LUTs (first LUT 7*a*, second LUT 7*b*) are provided. In the configuration shown in FIG. 16, an output from each of the first LUT 7*a* and the second LUT 7*b* is inputted to a multiplexer 20. Herein, a frame determination circuit 21 determines whether the current period is the first sub-sub-frame period or the second sub-sub-frame period. Based on a result of the determination, the multiplexer 20 outputs as output data one of the output from the first LUT 7*a* and the output from the second LUT 7*b*.

For example, the multiplexer 20 selects the output from the first LUT 7*a* in the first sub-sub-frame period and selects the output from the second LUT 7*b* in the second sub-sub-frame period. Herein, the first LUT 7*a* stores a value for performing overdrive processing in which a relatively high voltage is applied to the liquid crystal. On the other hand, the second LUT 7*b* stores a target gray scale or a value for performing overdrive processing in which a relatively low voltage is applied to the liquid crystal. Moreover, the frame determination circuit 21 determines whether the current period is the first sub-sub-frame period or the second sub-sub-frame period. In the case of using the image data format shown in FIG. 15, however, the first sub-sub-frame period and the second sub-sub-frame period are symmetric with each other; therefore, the frame determination circuit 21 fails to detect the current period. In order to avoid this disadvantage, the frame determination circuit 21 identifies the current period by a method of changing polarity of a vertical synchronizing signal or a horizontal synchronizing signal, a method of changing a length of a blanking period, a method of providing another identification signal, or the like.

With this configuration, the liquid crystal display device 1 can drive the liquid crystal panel at the timing shown in FIG. 13. As a result, the liquid crystal display device 1 requires no frame memory. Thus, the image display system according to the second embodiment allows reduction in memory cost as a whole and realizes high-quality overdrive processing. As in the case of the first embodiment, the format of the image data to be transferred from the image generation device 3 to the liquid crystal display device 1 is not limited to those shown in FIGS. 14 and 15. For example, plural pieces of image data may be transferred simultaneously in such a manner that a bit width is widened twice as described in the first embodiment.

There has been known that the field sequential drive method has the following disadvantage. That is, upon display of moving images, if a user tracks a moving object with his/her eyes, a display failure called color break occurs. In order to avoid this disadvantage, occasionally, one frame (about 60 Hz) is not divided into three sub-frames, but is divided into a larger number of sub-frames. Also in this method, the transfer circuit 6 of the image generation device 3 adopts the image data transfer method according to the second embodiment at the timing of each sub-frame in which the liquid crystal display device 1 is driven. As a result, the liquid crystal display device 1 requires no frame delay circuit. Thus, the image display system according to the second embodiment allows reduction in memory cost as a whole.

(Third Embodiment)

Figure 17:
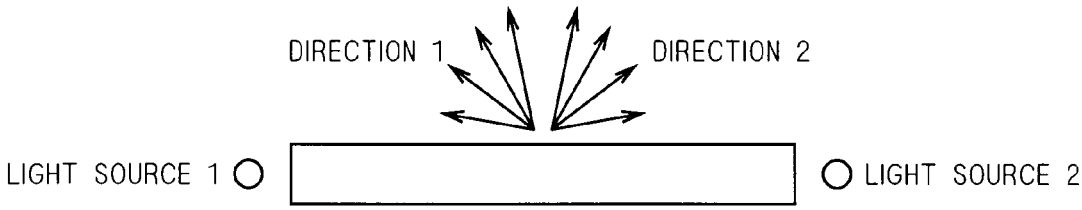
FIG. 17 shows a configuration of backlight according to a third embodiment of the present invention.

According to a third embodiment of the present invention, next, a liquid crystal display device 1 adopts a directivity scan backlight method. In the directivity scan backlight method, at least two light sources are provided. Herein, one of the light sources emits backlight to a display face in a specific direction while the other light source emits backlight to the display screen in a different direction. With reference to FIG. 17, detailed description will be given of the backlight in the directivity scan backlight method. As shown in FIG. 17, the light source 1 emits backlight having high directivity in a direction 1, that is, a left direction (reflection direction), but hardly emits backlight in a direction 2. On the other hand, the light source 2 emits backlight having high directivity in the direction 2, that is, a right direction (reflection direction), but hardly emits backlight in the direction 1.

The liquid crystal display device 1 according to the third embodiment has a liquid crystal panel provided on the backlight shown in FIG. 17. Herein, the light sources 1 and 2 emit the backlight alternately. In synchronization with the light emitting operations, the liquid crystal display device 1 controls a transmittance of the liquid crystal panel to display an image in the left direction (direction 1) and an image in the right direction (direction 2) which are different from each other. Moreover, the liquid crystal display device 1 according to the third embodiment allows a user to see an image which varies parallax with respect to a right eye and a left eye when the user observes a center of a screen of the liquid crystal display device 1 from a front side. Thus, the user can see a three-dimensional image.

Figure 18:
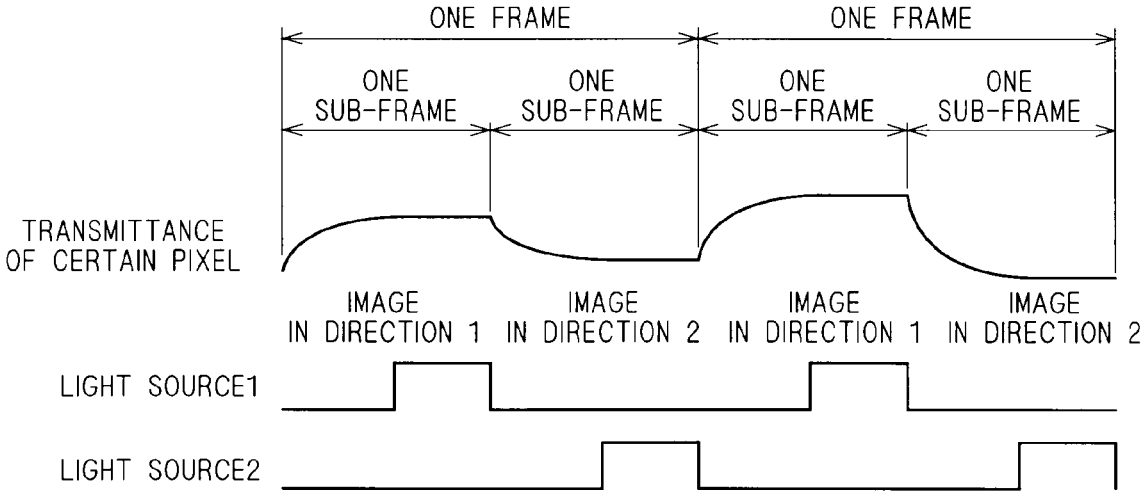
FIG. 18 shows a transmittance of a pixel and a timing of light emission from a light source according to the third embodiment of the present invention.

FIG. 18 shows a transmittance of a certain pixel and a timing of light emission from the light source in the liquid crystal display device 1 according to the third embodiment. In accordance with a timing chart shown in FIG. 18, an image for the direction 1 is written to a liquid crystal. When the pixel has a desired transmittance, the light source 1 emits the backlight in the direction 1. On the other hand, an image for the direction 2 is written to the liquid crystal. When the pixel has a desired transmittance, the light source 2 emits the backlight in the direction 2. Thus, the liquid crystal display device 1 according to the third embodiment allows display of the image in the direction 1 and the image in the direction 2 which are different from each other.

As in the case of the second embodiment, the liquid crystal display device 1 according to the third embodiment also has the following problem. That is, if the backlight is emitted to the entire screen in a row direction of the write to the liquid crystal, a desired image can not be obtained due to a relation between a time lag concerning the write to the liquid crystal between the upper side of the screen and the lower side of the screen and a response property of the liquid crystal.

In order to solve this problem, the liquid crystal display device 1 according to the third embodiment can also adopt the method of performing the write to the liquid crystal quickly as shown in FIG. 12 or the method of performing the write for every sub-sub-frame period obtained by dividing one sub-frame period as shown in FIG. 13, as in the case of the second embodiment. Herein, the configuration in the third embodiment is different from that in the second embodiment in the following point. That is, in the second embodiment, three sub-frames for red, green and blue are provided. On the other hand, in the third embodiment, two sub-frames for the direction 1 and the direction 2 are provided. The third embodiment can adopt the configuration in the second embodiment when three directions of directivity are provided.

FIG. 20 shows a format of image data to be transferred to the liquid crystal display device 1 of the image display system according to the third embodiment. In the image data format shown in FIG. 20, image data transferred at a left side (1 to 640 pixels) forms the image displayed in the direction 2 (left direction) in FIG. 17 and image data transferred at a right side (641 to 1280 pixels) forms the image displayed in the direction 1 (right direction) in FIG. 17. At a former half (upper sub-sub-frame period) of a first sub-frame period of a first frame period shown in FIG. 20, the left image is updated to a "left image 1" and the right image is updated to a "right image 0" which has been displayed in a preceding sub-frame period. At a latter half (lower sub-sub-frame period) of the first sub-frame period of the first frame period shown in FIG. 20, image data is equal to that at the former half (upper sub-sub-frame period).

At a former half (upper sub-sub-frame period) of a second sub-frame period of the first frame period shown in FIG. 20, the left image is updated to a "left image 1" which has been displayed in a preceding sub-frame period and the right image is updated to a "right image 1". At a latter half (lower sub-sub-frame period) of the second sub-frame period of the first frame period shown in FIG. 20, image data is equal to that at the former half (upper sub-sub-frame period). In second and subsequent frame periods shown in FIG. 20, similarly, the image is updated as described above.

Figure 19:
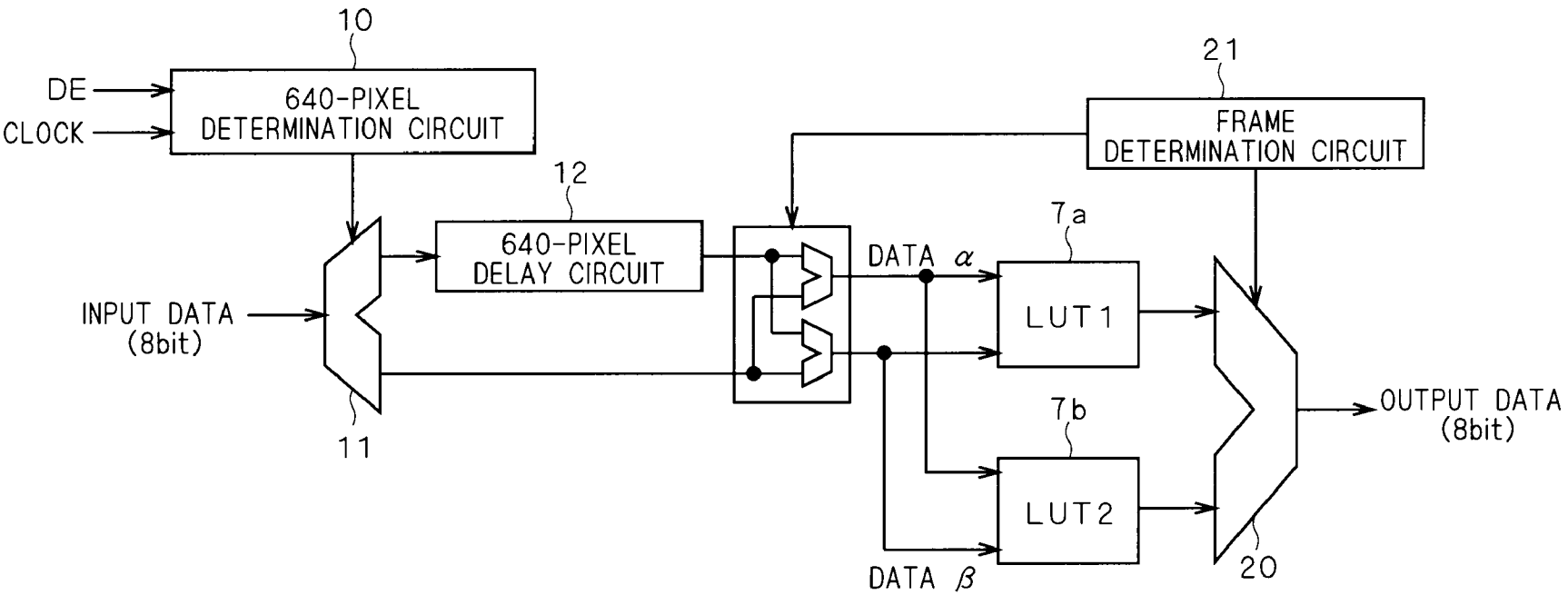
FIG. 19 shows a block diagram of an overdrive processing circuit according to the third embodiment of the present invention.

With reference to FIG. 19, next, description will be given of a configuration of the liquid crystal display device 1 that receives the image data having the image data format shown in FIG. 20. The configuration shown in FIG. 19 is different from that shown in FIG. 16 in the following point. That is, an output from a frame determination circuit 21 is inputted to an exchange circuit 30 that exchanges an output from a 640-pixel delay circuit 12 with an output from a demultiplexer 11. In the image data format shown in FIG. 20, the left image is located at the former half in a horizontal direction without fail. For this reason, with regard to the image which has been displayed in the preceding sub-frame period, the former half and the latter half must be exchanged with each other in the horizontal direction. In the configuration shown in FIG. 16, for example, the "left image 1" which has been displayed at the former half of the first sub-frame period in the horizontal direction is displayed at the latter half of the second sub-frame period in the horizontal direction. In the image data format shown in FIG. 20, on the other hand, the left image is located at the former half in the horizontal direction without fail. Therefore, the former half and the latter half in the horizontal direction are exchanged with each other in order that the "left image 1" is displayed at the former half of the second sub-frame period in the horizontal direction.

Herein, the frame determination circuit 21 detects the sub-frame period to control the exchange circuit 30. Thus, the exchange circuit 30 exchanges the former half and the latter half in the horizontal direction with each other. The configuration shown in FIG. 19 is equal to that shown in FIG. 16 except the foregoing operation. That is, the frame determination circuit 21 determines whether the current sub-sub-frame period is the former half or the latter half, and selects one of an output from a LUT 7*a* and an output from a LUT 7*b* based on a result of the determination. Herein, if the image which has been displayed in the preceding sub-frame period is outputted to the former half in the horizontal direction in place of the left image which is outputted to the former half in the horizontal direction without fail as shown in FIG. 20, the liquid crystal display device 1 does not require the exchange circuit 30 shown in FIG. 19. In the case of adopting the method of performing the write once quickly in one sub-frame period as shown in FIG. 12 in the second embodiment, the foregoing transfer operation is realized in such a manner that one frame period is divided into two sub-frame periods based on the image data format shown in FIG. 14.

As described above, the image display system according to the third embodiment adopts the directivity scan backlight method and the configuration described above. As a result, the liquid crystal display device 1 requires no frame delay circuit. Thus, the image display system according to the third embodiment allows reduction in memory cost as a whole.

In FIG. 13, one sub-frame is substituted with one frame, one sub-sub-frame is substituted with one sub-frame and normal backlight is used, so that the liquid crystal display device 1 can adopt a blinking backlight method for solving a moving image blurring phenomenon. In any methods by which one frame is divided into plural sub-frames, the liquid crystal display device 1 requires no frame delay circuit by improvement in sequence and timing of image data to be transferred from the image generation device 3 to the liquid crystal display device 1. Thus, the image display system according to the third embodiment allows reduction memory cost as a whole.

While the invention has been shown and described in detail, the foregoing description is in all aspects illustrative and not restrictive. It is therefore understood that numerous modifications and variations can be devised without departing from the scope of the invention.

What is claimed is:

1. An image display system comprising:

an image generation device that generates image data; and an image display device that receives said image data from said image generation device, performs overdrive processing based on said received said image data, and displays an image, wherein, said image generation device includes:

a rendering circuit that generates said image data to be outputted to said image display device for every frame;

a memory unit that holds plural pieces of said image data corresponding to at least two frames among plural pieces of said image data generated by said rendering circuit; and a transfer circuit that transfers plural pieces of said image data corresponding to two frames among plural pieces of said image data held by said memory unit to said image display device within one frame period, each of the transferred plural pieces of said image data corresponding to a single one of the two frames, and said image display device receives said plural pieces of said image data corresponding to two frames from said transfer circuit and performs the overdrive processing based on said received image data, such that the data of a current frame is transferred by the transfer circuit on one side of an effective image area and data of a perceding frame is transferred by the transfer circuit on another side of the effective image area.

2. The image display system according to claim 1, wherein the memory unit of said image generation device is larger in size than a memory of said image display device.

3. The image display system according to claim 1, wherein upon transfer of said image data in a first frame and said image data in a second frame preceding said first frame, said transfer circuit reduces a bit count of said image data in said second frame so as to be smaller than a bit count of said image data in said first frame.

4. The image display system according to claim 1, wherein said transfer circuit secures a bus width for transfer of said plural pieces of said image data corresponding to two frames.

5. The image display system according to claim 1, wherein said frame is divided into plural sub-frames, and the overdrive processing for said frame described in claim 1 is performed on each of said pluralsub-frames.

6. The image display system according to claim 1, wherein said image display device adopts a field sequential drive method.

7. The image display system according to claim 1, wherein said image display device adopts a directivity scan backlight method.

8. An image display system comprising:

an image generation device that generates image data; and an image display device that receives said image data from said image generation device, performs overdrive processing based on said received said image data, and displays an image, wherein, said image generation device includes:

a rendering circuit that generates said image data to be outputted to said image display device for every frame;

a memory unit that holds plural pieces of said image data corresponding to at least two frames among plural pieces of said image data generated by said rendering circuit; and a transfer circuit that transfers plural pieces of said image data corresponding to two frames among plural pieces of said image data held by said memory unit to said image display device within one frame period, each of the transferred plural pieces of said image data corresponding to a single one of the two frames, and said image display device receives plural pieces of said image data corresponding to the two frames from said transfer circuit and performs the overdrive processing based on said received image data, wherein a time interval between a timing that data of a current frame is inputted to the image display device and a timing that data of a preceding frame on a display pixel coordinate, which is equal to that of the data of the current frame, is inputted to the image display device is shorter than one frame period.

9. The image display system according to claim 8, wherein said transfer circuit selectively transfers one of said image data in a first frame and said image data in a second frame preceding said first frame for every pixel or for every plural pixels.

10. The image display system according to claim 8, wherein said transfer circuit selectively transfers one of said image data in a first frame and said image data in a second frame preceding said first frame for every row or for every plural rows.

11. The image display system according to claim 8, wherein said transfer circuit collectively transfers plural pieces of said image data corresponding to two frames for every row.

* * * * *